US011684224B2

(12) United States Patent
Pantermehl

(10) Patent No.: US 11,684,224 B2
(45) Date of Patent: Jun. 27, 2023

(54) REMOVABLE TOILET SEAT LIFTER AND METHOD

(71) Applicant: Arthur Pantermehl, Ashfield, MA (US)

(72) Inventor: Arthur Pantermehl, Ashfield, MA (US)

( * ) Notice: Subject to any disclaimer, the term of this patent is extended or adjusted under 35 U.S.C. 154(b) by 0 days.

(21) Appl. No.: 17/745,802

(22) Filed: May 16, 2022

(65) Prior Publication Data

US 2022/0273144 A1 Sep. 1, 2022

Related U.S. Application Data

(63) Continuation-in-part of application No. 15/980,710, filed on May 15, 2018, now abandoned.

(60) Provisional application No. 62/508,038, filed on May 18, 2017.

(51) Int. Cl.
*A47K 13/10* (2006.01)

(52) U.S. Cl.
CPC ..... *A47K 13/105* (2013.01)

(58) Field of Classification Search
CPC ..... A47K 13/105
USPC ..... 4/246.1; D8/307; D23/311
See application file for complete search history.

(56) References Cited

U.S. PATENT DOCUMENTS 2,236,576 A * 4/1941 Loebner ..... A47K 13/105 16/905
4,835,799 A * 6/1989 Beelart, Jr. ..... A47K 13/105 4/246.1
5,590,425 A * 1/1997 Janik, Jr. ..... A47K 13/105 4/246.1
6,634,032 B1 * 10/2003 Janik ..... A47K 13/105 4/246.1

* cited by examiner

*Primary Examiner* — Christine J Skubinna
(74) *Attorney, Agent, or Firm* — Michael C. Balaguy

(57) ABSTRACT

A removable toilet seat lifter that includes a seat mount, a handle, and a handle couple. The seat mount may be able to attach to a toilet seat. The handle may be able to lift the toilet seat and may have a coupling end and a user end. An extension member may connect the coupling end to the user end and may have two or more telescoping members nested within each other. The telescoping members may be able to slide within each other to adjust the length of the extension member. The handle couple may be able to couple the handle to the seat mount, in such a way that they may also be released from each other. The handle couple may be affixed to the seat mount and may include a handle receiver which may accept and retain the coupling end of the handle.

17 Claims, 5 Drawing Sheets

REMOVABLE TOILET SEAT LIFTER AND METHOD

CROSS-REFERENCE TO RELATED APPLICATION(S)

The present application is a continuation-in-part of U.S. Non-provisional patent application Ser. No. 15/980,710, filed May 15, 2018, pending. U.S. Non-provisional patent application Ser. No. 15/980,710 is related to and claims priority to U.S. Provisional Patent Application No. 62/508,038, filed May 18, 2017, expired. Both of these application are incorporated by this reference.

BACKGROUND

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of toilet seats of existing art and more specifically relates to sanitary devices for toilet seats.

RELATED ART

A toilet is a piece of hardware used for the collection or disposal of human urine and feces. They are often found in a small room referred to as a bathroom or lavatory. Flush toilets, which are common in many parts of the world, may be connected to a nearby septic tank or sewage pipe system, and are generally flushed with a handle attached to the toilet tank.

When using a toilet, individuals are often forced to physically touch a toilet seat, either to lift the seat or to lower the seat for use. This process can easily spread bacteria and other germs when individuals touch a seat only to then touch and handle other objects around the home and the like. Further, many individuals wish to avoid physically touching the seat altogether, however, this can be impractical. An efficient alternative is desired.

U.S. Pat. No. 8,132,272 to Anthony Esposito relates to a toilet seat lifting system. The described toilet seat lifting system includes a toilet seat in a generally ring like configuration having an upper surface, a lower surface, and a peripheral edge. A slot has an input opening. The input opening is located adjacent to a peripheral edge of the toilet seat. A lift assembly has an interior section, an exterior section, and an intermediate section. The interior section is positionable into the slot. The exterior section is in a cylindrical configuration. The exterior section extends radially exterior of the toilet seat. The intermediate section is positionable adjacent to the peripheral edge of the toilet seat.

SUMMARY

In view of the foregoing disadvantages inherent in the known art of sanitary devices for toilet seats, the present disclosure provides a novel removable toilet seat lifter and method. The general purpose of the present disclosure, which will be described subsequently in greater detail, is to provide a removable toilet seat lifter and method.

Methods of using a device for lifting a toilet seat is disclosed herein. The device includes a seat mount, a handle, and a handle couple. The seat mount is configured to attach to the toilet seat. The handle is configured to lift and lower the toilet seat, the handle having a coupling end and a user end, and including an extension member extending between the coupling end and the user end, the extension member having at least two nested telescoping members, the at least two nested telescoping members being slidably adjustable, allowing a total length of the at least two nested telescoping members to change. The handle couple configured to releasably couple the handle to the seat mount, the handle couple affixed to the seat mount and including a handle receiver configured to releasably couple with the coupling end of the handle.

According to another embodiment, a method for lifting a toilet seat is also disclosed herein. The method includes providing a device for lifting a toilet seat (as above); affixing the seat mount to the toilet seat; inserting the coupling end of the handle into the handle receiver of the handle couple; lifting the affixing the seat mount to the toilet seat; inserting the coupling end of the handle into the handle receiver of the handle couple; lifting the toilet seat via the handle; lowering the toilet seat via the handle; and removing the coupling end of the handle from the handle receiver of the handle couple.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a removable toilet seat lifter and method, constructed and operative according to the teachings of the present disclosure.

Figure 1:
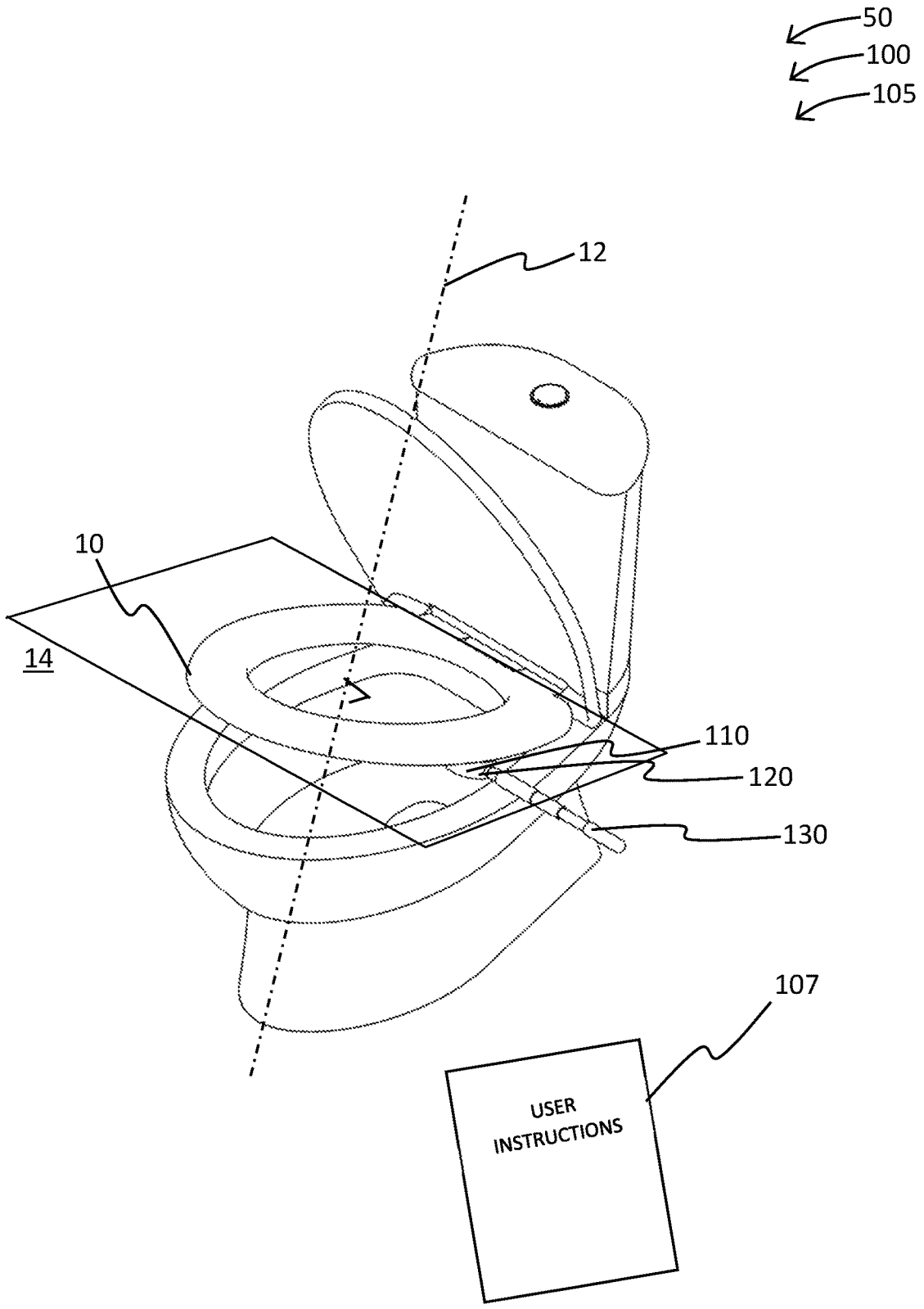
FIG. 1 is a top perspective view of a device for lifting a toilet seat, during an 'in-use' condition, and according to an embodiment of the disclosure.

The various embodiments of the present invention will be described with the appended drawings.

DETAILED DESCRIPTION

As discussed above, embodiments of the present disclosure relate to a toilet seat lifter and more particularly to a removable toilet seat lifter and method as used to improve the lifting a toilet seat.

Generally, the removable toilet seat lifter allows users to raise and lower a toilet seat without touching the seat itself. It utilizes a simple, inexpensive device having a handle to lift a toilet seat and avoid touching the main area of the seat. This may help ensure no contact is made with potential germs and bacteria located on the seat. It may provide a convenient, efficient, and sanitary way of lifting a toilet seat. The present disclosure may help promote sanitary practices within a home by limiting germs and bacteria to certain areas capable of being easily cleaned.

The removable toilet seat lifter is adapted to preventing germs and bacteria from spreading onto hands and other household items after using a toilet. The device may be adaptable to toilet seats of various sizes, rigidly engaging the toilet seat such that it may be easily lifted in conjunction with the handle. In a preferred embodiment, the device includes a circular mount adhered to the toilet seat and a removable lifter handle attached to the mount. The mount and the handle may be joined by a couple, which may comprise an extension and an aperture for receiving the extension. The aperture may retain the extension by friction so that a user may easily insert and remove the handle from the mount. The handle may measure six to eight inches long in the preferred embodiment, while the extension which fits the aperture may measure up to an inch. A telescoping end may also be included to compact the device and place it in a backpack, purse, or other storage area. The device may also be easily washed and sanitized once detached, being made of a non-absorbent material. The tool could be useful for lifting both household and commercial toilets. Two other embodiments are disclosed. A first alternative embodiment includes a small handle with a claw-like receiving end designed to grasp the rim of the toilet seat. A second alternative embodiment includes a handle having a ninety-degree joint which aligns the handle on the side of the toilet as opposed to the front. The exact specifications may vary.

In practice, the seat mount could remain semi-permanently affixed to the toilet seat, while one or more handles were used in conjunction with it to lift the toilet seat. For example, a plurality of handles, preferably manufactured inexpensively to enable them to be used disposably, could be provided in a proximal location to the toilet seat. A user could insert and use the handle once, and then dispose of it. Alternatively, a user may carry a handle on their person, and use the handle with any toilet they use, especially if the variation having the claw-like receiving end is used.

The removable toilet seat lifter is adapted to inhibit germs and bacteria from spreading onto hands and other household items after using a toilet is disclosed. In particular, the disclosure includes a device adaptable to a toilet, which allows lifting of a toilet seat. The device may include a mount adhered to the toilet seat and a removable lifter linkage attached to the mount. The lifter/dowel device may measure 6" to 8" long and may slide into the seat mount up to an inch. The device may also be easily washed and sanitized once detached; however, users may dispose of the lifter unit once used. The tool could be useful for lifting both household and commercial toilets. The lifter may be grasped by a user to lift or lower the seat and may be quickly removed from the mount for washing. Two other possible variations are available. These include a small handle with a receiving end designed to grasp the rim of the toilet seat. In one variation the receiving end is rotated 90 degrees for placement on the side of the toilet as opposed to the front. A telescoping end could also be included to compact the device and place it in a backpack, purse, or other storage area. The exact specifications may vary.

For purposes of this disclosure, "touchless" or "touchlessly" means that the handle is configured to couple to and uncouple from the seat mount without user interaction with the coupling end. For purposes of this disclosure, "threadless" means that the handle coupling mechanism does not include threads. For purposes of this disclosure, "friction fit" means that the coupling end fits inside the seat mount and connects to the seat mount with user-generated axial force. In some embodiments, "friction fit" means that the coupling end fits inside the seat mount and connects to the seat mount with user-generated axial force. For purposes of this disclosure, "personal to the user" means that the handle travels with the user.

Referring now more specifically to the drawings by numerals of reference, there is shown in FIGS. 1-4, various views of a toilet seat lifter or a device 100 for lifting a toilet seat.

FIG. 1 shows the device 100 during an 'in-use' condition 50, according to an embodiment of the present disclosure. Here, the device 100 may be beneficial for use to lift toilet seat 10 without contacting toilet seat 10. Toilet seat 10 may be characterized as being planar (ref. plane 14) and substantially circumscribing a toilet seat axis 12, which is normal said plane 14 of toilet seat 10.

The device 100 may include a seat mount 110, a handle couple 120, and a handle 130. The seat mount 110 is configured to attach to the toilet seat 10. The handle couple 120 may be configured to releasably couple handle 130 to seat mount 110. Preferably, handle couple 120 will be affixed to seat mount 110. The handle 130 may be configured to lift and lower the toilet seat when handle couple 120 couples handle 130 to seat mount 110.

According to one embodiment, the device 100 may be arranged as a kit 105. In particular, the device 100 may further include a set of instructions 107. The instructions 107 may detail functional relationships in relation to the structure of the device 100 such that the device 100 can be used, maintained, or the like, in a preferred manner.

Figure 2:
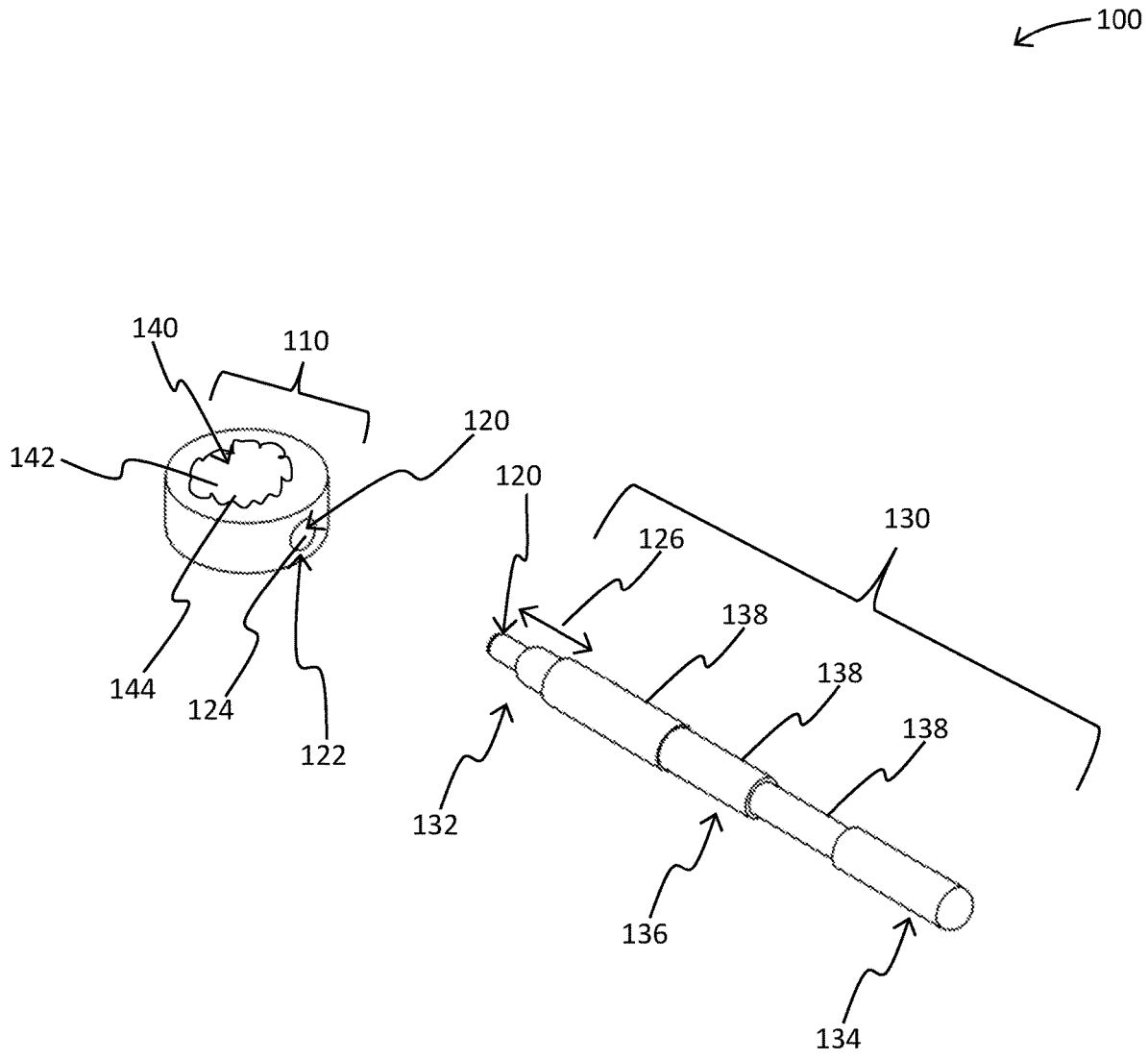
FIG. 2 is a top perspective view of the device of FIG. 1, showing the device in isolation.

FIG. 2 is a bottom perspective view of the device of FIG. 1, according to an embodiment of the present disclosure. Here the seat mount 110 is shown separated from the handle 130. The handle 130 may have a coupling end 132, a user end 134, and an extension member 136 extending between the coupling end 132 and the user end 134. The extension member 136 may have at least two nested telescoping members 138, which are slidably adjustable, allowing a total length of the at least two nested telescoping members 138 to change, thereby moving user end 134, relative to coupling end 132. In some versions, handle 130 does not contain gears or springs. In some versions, handle 130 does not directly connect or serve as the toilet seat hinge. In some versions, handles 130 does not hold water. In some versions, handle 130 contains a single shaft comprising nested telescoping members 138.

As shown, the handle couple 120 may be configured to releasably couple handle 130 to seat mount 110 and may be affixed to seat mount 110. The handle couple may include handle receiver 122 configured to releasably couple with coupling end 132 of handle 130. Further, handle receiver 122 of handle couple 120 may include interior cavity 124 conformed to coupling end 132 of handle 130, such that coupling end 132 of handle 130 may be nested within handle receiver 122 of handle couple 120. Handle receiver 122 of handle couple 120 may be integrated with seat mount 110. In some versions, handle receiver 122 is a round or substantially round socket. In some versions, neither the handle couple 120 nor the handle receiver contain a packing gland.

According to one embodiment the coupling end 132 of handle 130 may be substantially cylindrical in shape, and the interior cavity 124 of handle receiver 122 of handle couple 120 may also be substantially cylindrical in shape, being conformed to coupling end 132 of handle 130. In this embodiment, the coupling end 132 and the interior cavity 124 each share a cylinder height 126, with the interior cavity 124 being conformed to coupling end 132. Preferably, cylinder height 126 measures approximately one inch.

According to a preferred embodiment, the seat mount 110 may include an adhesive mount 140 including a contact face 142 and an adhesive 144. The contact face 142 may be configured to abut with toilet seat 10 (FIG. 1), for example, the contact face 142 may be substantially flat or otherwise structured to mate with toilet seat 10. The adhesive compound 144 may be affixed to contact face 142, being configured to glue or otherwise couple contact face 142 with toilet seat 10.

Figure 3:
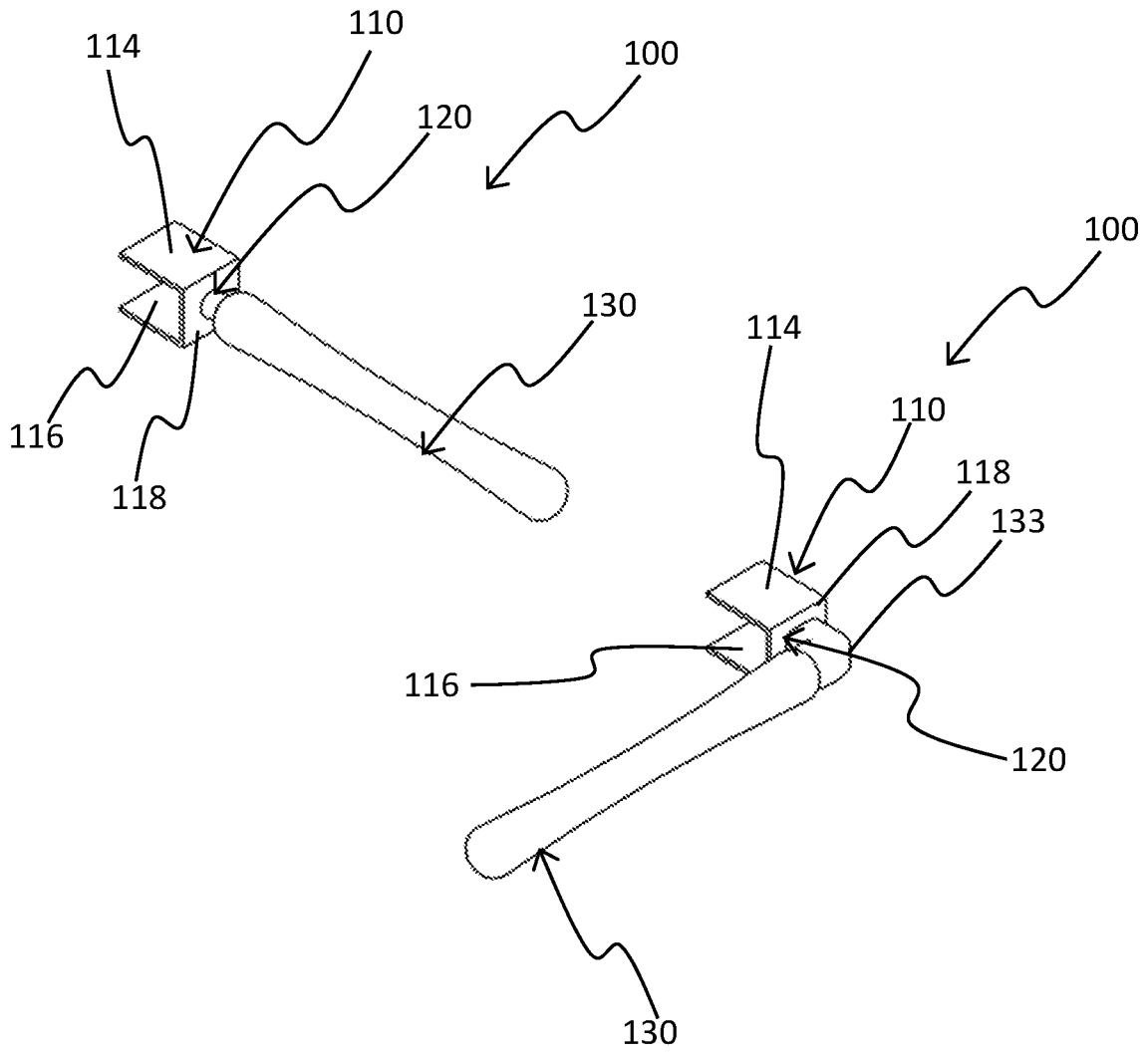
FIG. 3 is a perspective view of two variations of a device for lifting a toilet seat, according to an alternate embodiment of the present disclosure.

FIG. 3 is a perspective view of two alternate embodiments of the device 100 for lifting a toilet seat. Here, the seat mount 110 may be embodied as or otherwise include a seat clamp that includes, for example, a first clamp member 114, a second clamp member 116, and a joining member 118 coupling first clamp member 114 to second clamp member 116. The first clamp member 114 and the second clamp member 116 may be configured to engage the toilet seat 10 (FIG. 1). According to one exemplary embodiment, the first clamp member 114 may be coupled perpendicularly to the joining member 118, and the second clamp member 116 may likewise be coupled perpendicularly to the joining member 118, and parallel to the first clamp member 114 (e.g., similar to a 'C' or 'U' shape).

According to one embodiment, the handle 130 may extend radially from the toilet seat axis 12 (FIG. 1) of toilet seat 10 where handle couple 120 joins handle 130 to seat mount 110. In an alternate embodiment, the handle 130 may extend substantially tangential to toilet seat 10 where handle couple 120 joins handle 130 to seat mount 110. In an alternate embodiment, the handle 130 may further include a ninety-degree elbow 133.

Figure 4A:
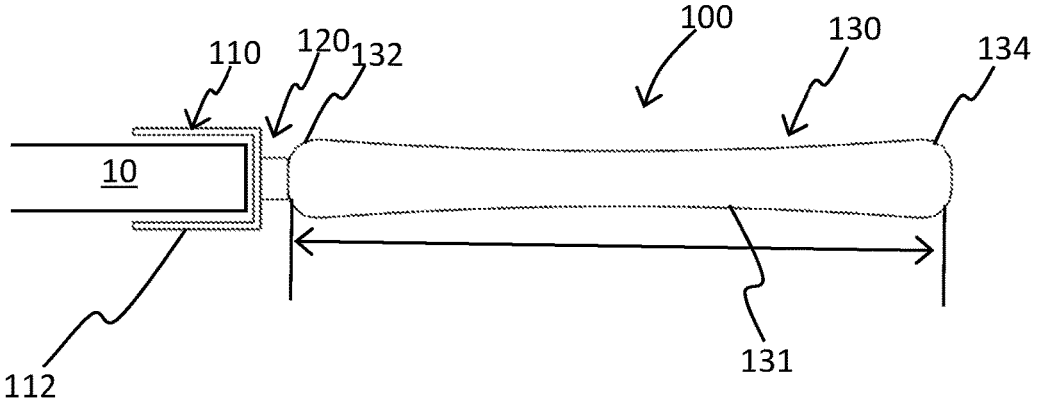
FIG. 4A is a side view of an embodiment of the device for lifting a toilet seat, according to the present disclosure.
Figure 4B:
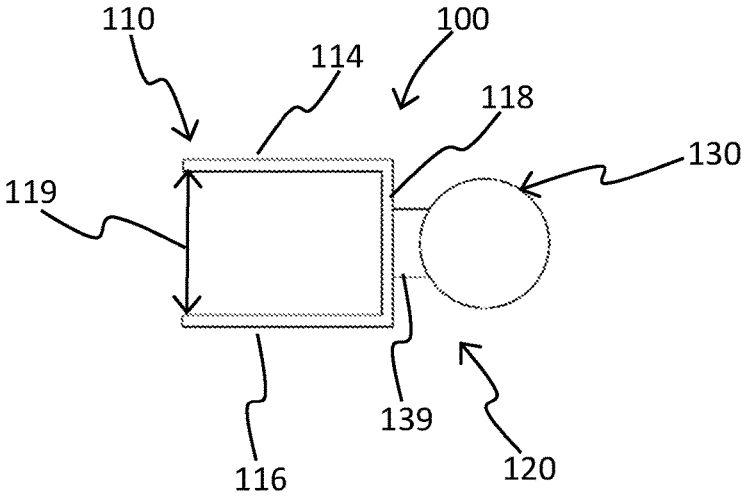
FIG. 4B is a side view of an embodiment of the device for lifting a toilet seat, according to the present disclosure.
Figure 4C:
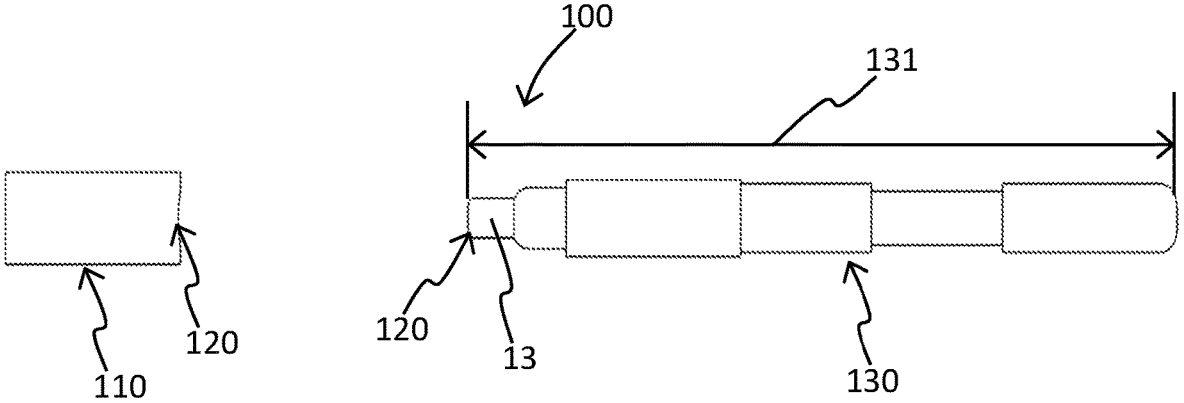
FIG. 4C is a side view of an embodiment of the device for lifting a toilet seat, according to the present disclosure.

FIGS. 4A-C are a side views of various embodiments of the device 100 for lifting a toilet seat. As above, the device 100 may include the seat mount 110, the handle couple 120, and the handle 130. Seat mount 110 and handle 130 may be made of plastic in a preferred embodiment.

As shown in FIG. 4A, and as discussed above, the handle 130 may extend radially from the toilet seat axis 12 (FIG. 1). As shown, the handle 130 may be substantially tubular. Handle 130 have a handle length 131 extending from coupling end 132 to user end 134. In a preferred embodiment, handle length 131 may measure between six inches eight inches when handle 130 is not extended.

As shown in FIG. 4B, and as discussed above, the handle 130 may extend substantially tangential to toilet seat 10 where handle couple 120 joins handle 130 to seat mount 110. Here, the seat mount 110 may be embodied as the seat clamp, with the joining member 118 interspersed between the first clamp member 114 and the second clamp member 116. Further joining member 118 interspersed between the first clamp member 114 and the second clamp member 116 may define a separation-distance 119. The separation-distance 119 may be limited so as to be no larger than the toilet seat 10 is thick, and such that first clamp member 114 and second clamp member 116 are configured to exert a clamping force on the toilet seat 10 when installed on or otherwise engaging toilet seat 10. According to one embodiment, the handle couple 120 may further include articulating joint 139, which is configured to allow handle 130 to be selectively angled relative to handle couple 120 (e.g., radially, as in FIG. 4A, tangentially, as in FIG. 4B, or other angles therebetween and beyond).

As shown in FIG. 4C, and as discussed above, the seat mount 110 may be substantially cylindrical. Here, the handle length 131 may increase as handle 130 is deployed. In particular, the handle length 131 may telescopically vary between a maximum length and a minimum length.

Upon reading this specification, it should be appreciated that, under appropriate circumstances, considering such issues as user preferences, design preference, structural requirements, marketing preferences, cost, available materials, technological advances, etc., other structural arrangements such as, for example, varying handle shapes, additional retention mechanisms, etc., may be sufficient.

Figure 5:
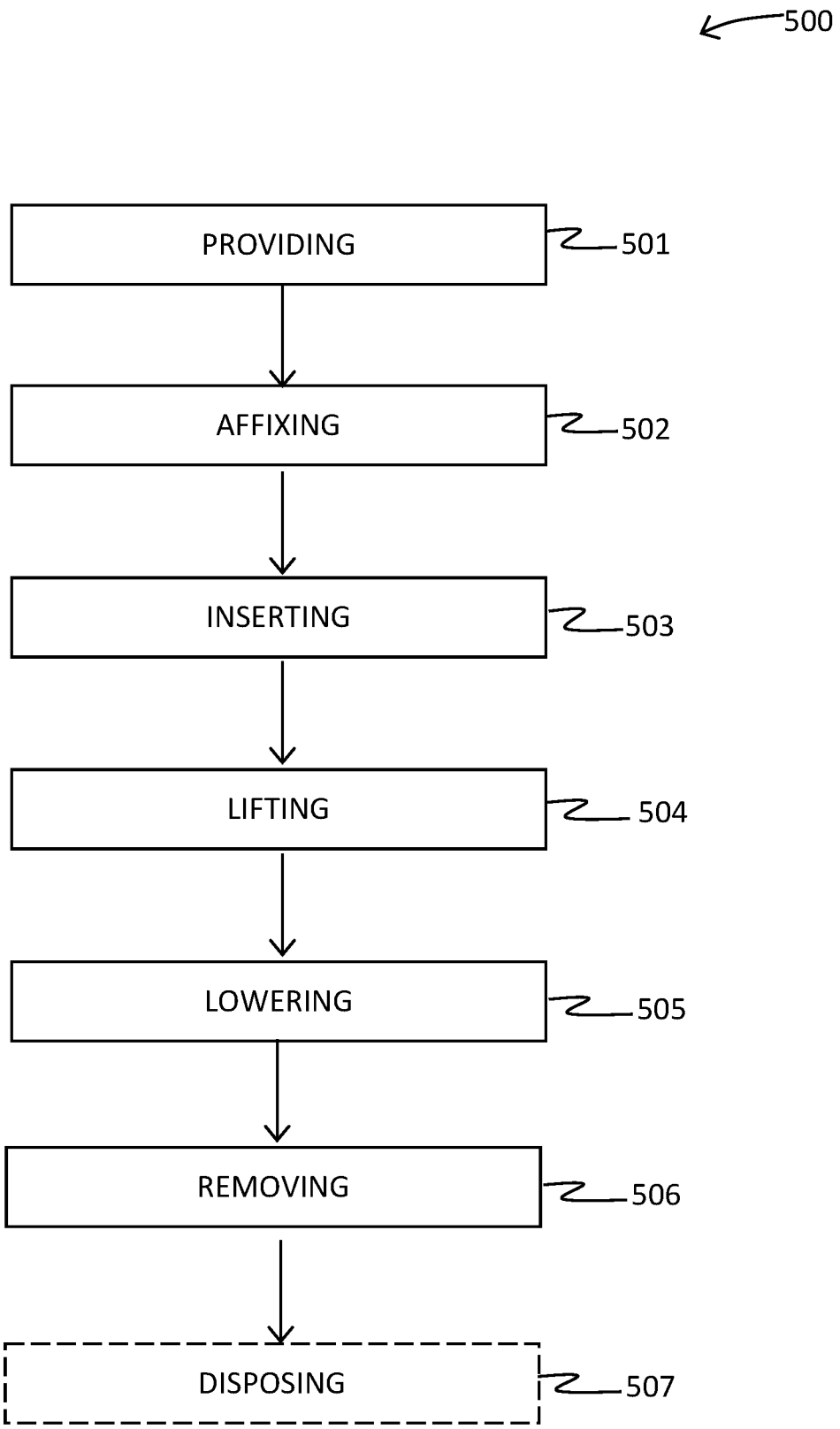
FIG. 5 is a flow diagram illustrating a method of use for lifting a toilet seat without contacting the toilet seat, according to an embodiment of the present disclosure.

FIG. 5 is a flow diagram illustrating a method for lifting a toilet seat without contacting the toilet seat, according to an embodiment of the present disclosure. In particular, the method 500 for lifting a toilet seat may include one or more components or features of the handle 100 as described above. As illustrated, the method 500 for lifting a toilet seat without contacting the toilet seat may include the steps of: step one 501, providing a device for lifting a toilet seat, the device including a seat mount, the seat mount configured to attach to the toilet seat, a handle, the handle configured to lift and lower the toilet seat, the handle having a coupling end and a user end, and including an extension member extending between the coupling end and the user end, the extension member having at least two nested telescoping members, the at least two nested telescoping members being slidably adjustable, allowing a total length of the at least two nested telescoping members to change, and a handle couple, the handle couple configured to releasably couple the handle to the seat mount, the handle couple affixed to the seat mount and including a handle receiver configured to releasably couple with the coupling end of the handle; step two 502, affixing the seat mount to the toilet seat; step three 503, inserting the coupling end of the handle into the handle receiver of the handle couple; step four 504, lifting the toilet seat via the handle; step five 505, lowering the toilet seat via the handle; and step six 506, removing the coupling end of the handle from the handle receiver of the handle couple. According to one embodiment, the method 500 may further include the step of step seven 507, disposing of the handle.

It should be noted that step 507 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for lifting a toilet seat without contacting the toilet seat, are taught herein.

The embodiments of the disclosure described herein are exemplary and numerous modifications, variations and rearrangements can be readily envisioned to achieve substantially equivalent results, all of which are intended to be embraced within the spirit and scope of the disclosure. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A method comprising:

providing a lift comprising:

a handle having a coupling end, a user end, and a middle portion between the coupling end and the user end; and a seat mount comprising a handle couple configured to touchlessly receive and secure the handle into the seat mount wherein the seat mount attaches to a toilet seat; and attaching the handle to the handle couple;

wherein the coupling end has a first diameter, adjacent the middle portion, wherein the first diameter is less than a diameter of the middle portion and a second diameter at a tip of the coupling end wherein the second diameter is less than the first diameter.

2. The method of claim 1 further comprising lifting the toilet seat with the lift.

3. The method of claim 2 further comprising lowering the toilet seat with the lift.

4. The method of claim 3, further comprising removing the handle.

5. The method of claim 4, wherein the handle couple is integrated with the seat mount.

6. The method of claim 5, wherein the handle couple includes an interior cavity shaped to receive the handle.

7. The method of claim 1, wherein the seat mount includes an adhesive mount with a contact face that abuts the toilet seat.

8. The method of claim 7, wherein the seat mount is substantially cylindrical.

9. The method of claim 8, wherein the handle is substantially tubular.

10. The method of claim 9, wherein a distance between a tip of the coupling end to a tip of the the user end is 6-8 inches.

11. The method of claim 10, wherein the toilet seat is planar and the handle extends away from the toilet seat.

12. The method of claim 11, wherein the handle further includes a ninety degree bend.

13. The method of claim 12, wherein the handle has a friction fit directly into the seat mount.

14. The method of claim 13, wherein the handle couple does not contain a packing gland, gears, or springs.

15. The method of claim 14, wherein the attaching-the-handle step comprises applying axial force to the handle causing it to move into the handle couple.

16. The method of claim 15, wherein the handle coupling is threadless.

17. The method of claim 16 wherein the handle couple comprises a cavity for receiving the coupling end.

* * * * *